US008899652B2

(12) United States Patent
Brill et al.

(10) Patent No.: US 8,899,652 B2
(45) Date of Patent: Dec. 2, 2014

(54) ARMORING COMBATANTS' COMPARTMENT IN A WHEELED VEHICLE AGAINST EXPLOSIVE CHARGES

(75) Inventors: Alon Brill, Haifa (IL); Gil Hazan, Nofit (IL); Asher Levy, Shlomi (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 0 days.

(21) Appl. No.: 13/262,916

(22) PCT Filed: Mar. 28, 2010

(86) PCT No.: PCT/IL2010/000270

§ 371 (c)(1),
(2), (4) Date: Dec. 29, 2011

(87) PCT Pub. No.: WO2010/116361

PCT Pub. Date: Oct. 14, 2010

(65) Prior Publication Data

US 2012/0111181 A1 May 10, 2012

(30) Foreign Application Priority Data

Apr. 5, 2009 (IL) ..... 198017

(51) Int. Cl.

| | |
|---|---|
| ***F41H 7/02*** | (2006.01) |
| ***F41H 5/013*** | (2006.01) |
| ***F41H 7/04*** | (2006.01) |
| *B62D 25/20* | (2006.01) |

(52) U.S. Cl.

CPC ..... *F41H 7/042* (2013.01); *F41H 5/013* (2013.01)

USPC ..... 296/35.1; 296/187.07; 296/187.08; 296/193.07; 89/36.08

(58) Field of Classification Search

USPC ..... 296/187.07, 187.08, 193.07, 190.03, 296/35.1, 35.2; 89/36.01, 36.02, 36.09, 89/36.08, 937

See application file for complete search history.

(56) References Cited

U.S. PATENT DOCUMENTS

| | | | |
|---|---|---|---|
| 1,168,926 | A | 1/1916 | Ambrozy |
| 1,222,283 | A | 4/1917 | Gray |
| 3,023,913 | A | 3/1962 | Talbert |
| 4,326,445 | A | 4/1982 | Bemiss |
| 5,533,781 | A | 7/1996 | Williams |
| 5,663,520 | A | 9/1997 | Ladika |
| 7,228,927 | B2 | 6/2007 | Hass |
| 7,325,475 | B2 | 2/2008 | Long |
| 7,357,062 | B2 | 4/2008 | Joynt |

(Continued)

FOREIGN PATENT DOCUMENTS

| | | |
|---|---|---|
| CA | 2630221 | 5/2007 |
| IL | 195167 | 11/2008 |

*Primary Examiner* — Glenn Dayoan
*Assistant Examiner* — Melissa A Black
(74) *Attorney, Agent, or Firm* — Rodney J. Fuller; Booth Udall Fuller, PLC

(57) ABSTRACT

A Wheeled vehicle comprises a chassis and a combatants' compartment for protection from an explosion, where the combatants' compartment is formed with an internal space and a bottom area sector attachable to the chassis and where the compartment has a plurality of inner beams that are formed with anchoring means along their lengths and installed in the combatants compartment's inn space and a plurality of outer beams attached to the chassis, where the anchoring means pass through openings formed in the bottom area sector of the combatants' compartment and protrude outwards from it for connecting the inner beams to the outer beams.

9 Claims, 7 Drawing Sheets

(56) References Cited

U.S. PATENT DOCUMENTS

Figure 1:
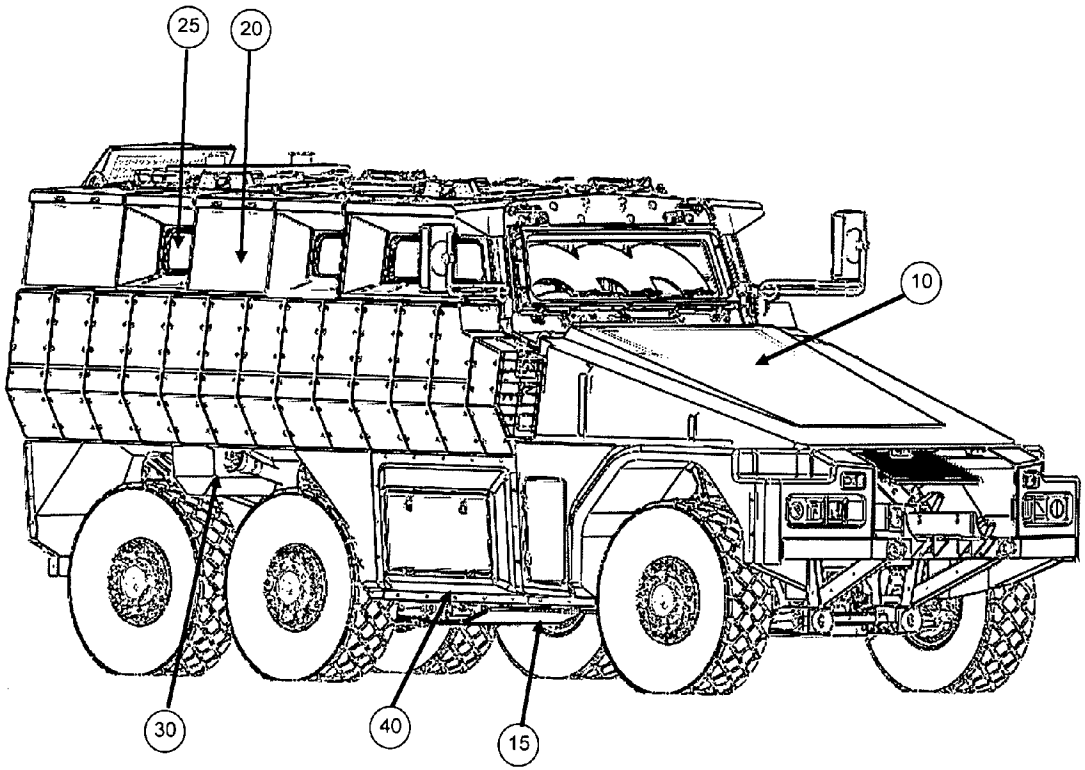

| | | | | |
|---|---|---|---|---|
| 7,997,182 | B1 * | 8/2011 | Cox | 89/36.09 |
| 8,418,594 | B1 * | 4/2013 | Dunne et al. | 89/36.02 |
| 2006/0087152 | A1 | 4/2006 | Kuriakose | |
| 2006/0288856 | A1 | 12/2006 | Labock | |
| 2007/0017360 | A1 | 1/2007 | Cohen | |
| 2008/0066613 | A1 | 3/2008 | Mills | |
| 2008/0111396 | A1 | 5/2008 | Barbe | |
| 2008/0116726 | A1 | 5/2008 | Herold, III | |
| 2008/0173167 | A1 | 7/2008 | Mills | |
| 2009/0322112 | A1 * | 12/2009 | Epstein et al. | 296/35.1 |

* cited by examiner

ARMORING COMBATANTS' COMPARTMENT IN A WHEELED VEHICLE AGAINST EXPLOSIVE CHARGES

RELATED APPLICATION DATA

This application is the U.S. National Stage of PCT/IL2010/000270, filed Mar. 28, 2010, which claims the benefit of Israel Application No. 198017 filed Apr. 5, 2009, the contents of each of which are herein incorporated by reference for all purposes.

FIELD OF THE INVENTION

The present invention, the subject matter of this application, is found in the field of devices serving to provide added protection to combat vehicles in general and within the field of means and methods for protecting vehicles against explosive charges activated against them in particular.

BACKGROUND OF THE INVENTION

Military Vehicles in combat areas might be exposed, inter alia, unto a variety of threats executed by activating explosive charges in the vicinity of the lower (bottom) section of the vehicle.

An outstanding example of threats in this category is presented by any of the large variety of different mines. Activating a mine under a vehicle beneath the under belly (for example, by deploying a sensor that detects when a vehicle passes over or near it, or alternatively, by employing a pressure sensitive mine that senses when a vehicle is driven (passes) over it might expose the bottom belly of the vehicle to destructive effects, e. g., due to a pressure wave, heat, acceleration or shards generated by the explosion.

Any professional would understand that using the expression "mine" in this patent application, is done solely for the sake of convenience and clarity, and it is meant to cover other and additional types of anti vehicle threats that are also based, as said, on the activation of an explosives charge in the vicinity of the lower part of a vehicle, for example—an improvised explosive device (known as IED), road-side charges, standard pressure activated mines and airborne launched explosive charges—such as RPG's (namely—Rocket Propelled Grenades) and the like.

In the recent years, many combat arenas include urban and rural built up areas, that mandates the units operating in them to utilize relatively light wheeled vehicles (in contra distinction to the tracked vehicles that provide a certain level of protection), as they provide mobility and maneuverability while simultaneously causing less hardship and harm to the civilian infrastructure (for example—roads, bridges, electricity power networks, water and sewerage facilities).

The challenge that the mines threats sets before the wheeled vehicles is very severe, due to the constraints affecting the wheeled vehicles, namely its inability to "carry" on it appropriate protecting means, that is relatively rather heavy for such vehicles (as opposed to the carrying capabilities of the more robust tracked vehicles, where it is less obstructive). This challenge becomes more stringent at times when the wheeled vehicles are also threatened and challenged, additionally, by threats aimed at the upper parts of the vehicle (for example—shooting by light arms and missiles). The weight carrying limits applying to wheeled vehicles mandates, hence, that the designer shall compromise and use a lower protection level, or alternatively, select more expensive materials for the armoring solutions—which, unluckily, are characterized by relatively short life times (for example, composite materials, ceramics or similar items).

Over the course of recent years, several solutions were proposed to cope with this challenge. For example—

Patent application publication US 2008/0066613 of—Mills et al, described a perforated hull for vehicle blast shield, which is based on a combination of a V-hull shape and an energy observing structure.

Subsequently, in patent application publication US 2008/0173167, Mills et al provide a description of a vehicular based mine blast energy mitigation structure that, as said there, might have a V-shaped hull and an energy absorbing structure incorporated into the chassis of a wheeled vehicle, wherein the energy absorbing structure comprises a truss-like structure including I-beams.

The solutions that were offered by Mills are verily complicated and relatively heavy, because they are based on adding material at the lower section of the vehicle—namely adding a specific (dedicated) structure to provide the protection while the vehicle referred to is of the "Body-on-Frame" type.

Patent application publication US 2008/0111396 of Barbe et al describes a protection device for a vehicle floor pan that incorporates at least one layer of deformable reinforcements, positioned between a plane front plate and a plane rear plate, the surface density of the front plate being greater than that of the reinforcement.

Note that this means that the solution suggested by Barbe (et al) relies on assigning a dedicated volume for the sake of including a dedicated protection within the dedicated volume.

Williams' U.S. Pat. No. 5,533,781 describes an armoring assembly for protecting the under belly of a wheeled vehicle by using a structure that comprises a fibrous material that is secured to the upper surface of the vehicle floor, and a ballistic panel/blast shield disposed below the lower surface of the floor and spaced there from so as to form an air gap there—namely between them.

We stress that the solution suggested by Williams requires—as the former one, assigning a dedicated volume for inserting the dedicated protection into it.

U.S. Pat. No. 7,228,927 patent of Hass et al, describes a vehicle protection means against the effect of a land mine wherein a wheeled vehicle is provided with wheel axels and drives built into the front and/or the rear building blocks. A residual mobility of a remaining portion of the vehicle is preserved, even though one of the front or rear building block is separated from the main building block due to the explosive shock wave generated by driving over and detonating a land mine, because each of the building blocks has a separate drive for rotating the wheel axel connected to the block.

This solution is relatively expensive, and inter alia it requires two separate and independent propulsion means. The enhanced survivability that this solution provides, as an outcome of the vehicle's ability to continue moving after the explosion (although in a limited manner) depends on the type and on the location in which the threat did act, for example, if it was a pressure mine activated by the wheel of a vehicle that over-ran the mine top. The enhanced survivability that this solution provides is valid only in case that the mine was detonated against the specific block on which the wheel is mounted, while leaving behind—unharmed, an additional block of the vehicle that is capable of the non harmed propulsion capability that survived.

U.S. Pat. No. 7,357,062 of Joint, describes a mine resistant armored vehicle that comprises a front wheel drive assembly and a rear wheel drive assembly. The vehicle may include a monocoque body—namely, in automotive terms—a vehicle construction in which the body is united with the frame and machinery or type of construction in which the outer layer absorbs all or most of the stress. The monocoque body comprised of a sheet metal. The engine and the drive train are operatively and detachably affixed to the body. The bottom of the body is generally V-shaped. The bottom portion further includes a metal energy-absorbing member extending longitudinally along—, and affixed to—, the interior of the apex of the V.

The solution suggested by Joint focuses solely on the design of the bottom of the monocoque body in the V configuration and is teaching the locating of an additional and dedicated means along the length of the a monocoque body.

Thus, in consequence of the existing drawbacks detailed above when referring to the prior art, in the period preceding the presentation of the present invention, a need exists for devising a solution enabling to protect the lower (bottom) parts of wheeled vehicles against mines, that— a. Would be low priced and relatively amenable to simple production and installation.
b. Its implementation would not be subject to assigning a dedicated relatively large free volume solely for enabling to position the protection means in there (while this would consequently reduce the inner volume assigned to the combatants and equipment or entailing deviation from the boundaries of the vehicle, thus reducing the traversablity of the vehicle and increasing its silhouette "foot print".
c. Would lead towards a reduction in the number of the additional dedicated protection means—that their sole task is expressed in providing additional armoring (and naturally, add "dead weight" on the vehicle).
d. Would enable convenient and simple interfacing with and on existing or planned (future) all wheeled automotive platforms.
e. Would be effective and efficient from the protective aspect but simultaneously would be of a relative light weight.

SUMMARY OF THE PRESENT INVENTION

The present invention, the subject matter of this application, meets the needs that we have presented above trough positioning massive and robust beams on the exterior of the combatants' compartment of the wheeled vehicle, wherein the combatants' compartment of the wheeled vehicle by itself is designed (formed) as a kind of a "capsule" which has an inner assigned free volume and a bottom (lower) portion that is connectable to the chassis of the wheeled vehicle.

The massive beams are positioned on the exterior side of the bottom sector, wherein they are connected to the automotive chassis of the wheeled vehicle (wherein in one preferred embodiment of the present invention, from the automotive point of view, the combatants' compartment of the wheeled vehicle is designed to be a monocoque body, in contradistinction to the "Body on a Frame" structure).

Concurrently, these external massive beams are connected to anchoring means that protrude and extend beyond the bottom sector of the combatants' compartment, and that constitute an integral part of inner beams that are positioned on the other side of the bottom sector, inside the combatants' compartment (of the wheeled vehicle).

In this manner, the external beams array protects, strengthens and ruggedizes the bottom sector of the combatants' compartment, albeit with minimal subtraction from the available inner space of the combatants' compartment as is required for the inclusion of the dynamic motion of the bottom sector that takes place upon absorbing the loads that are generated by the explosion of the mine (the explosive charge) and while providing a substantial saving in undesired weight.

BRIEF DESCRIPTION OF THE ACCOMPANYING DRAWINGS

The present invention will be described by an example herein under, in conjunction with the accompanying figures. Identical components, wherein some of them are presented in the same figure—or in case that a same component appears in several figures, will carry an identical number.

FIG. 1 constitutes an illustration view of an example of a wheeled vehicle in which a method and means in accordance with the present invention are implemented, for protection against threats of mines.

Figure 2:
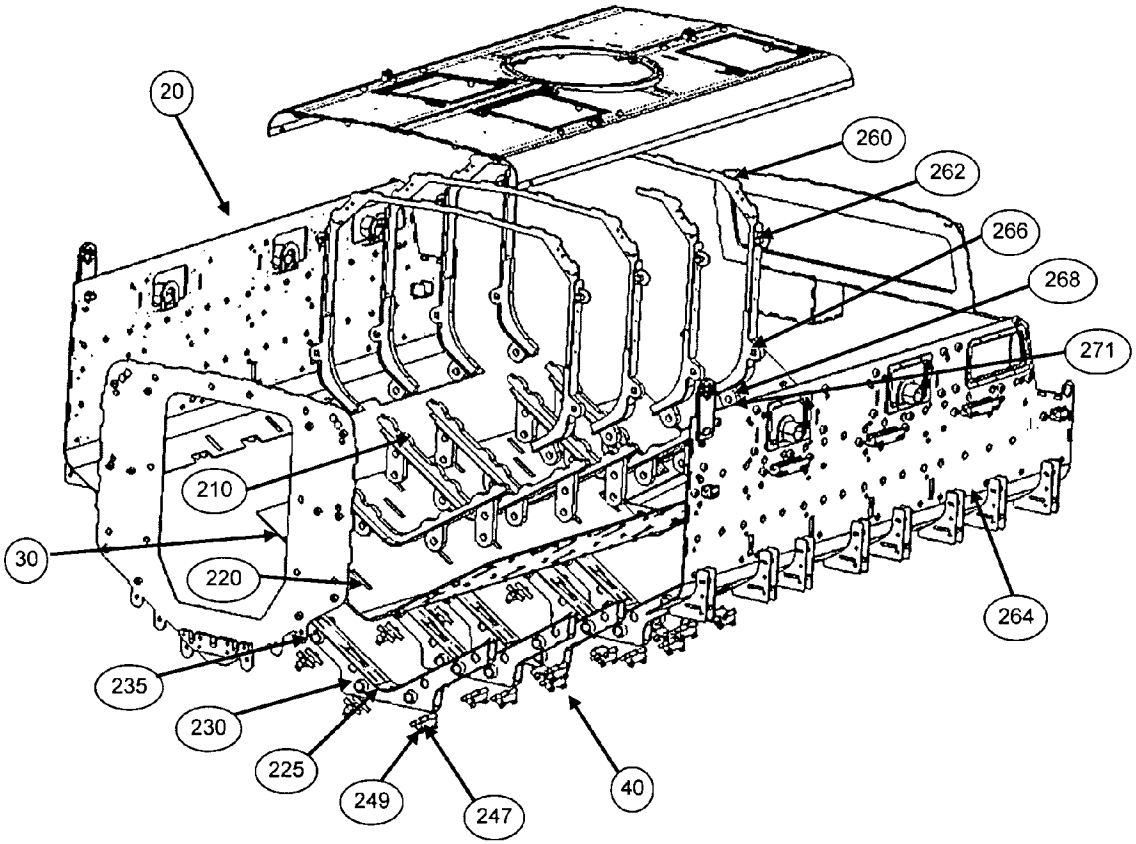

FIG. 2 constitutes an "exploded" view presentation of the components making up an example combatants compartment in a wheeled vehicle that includes the components of the means in accordance with the present invention, for protection against threats of mines.

Figure 3:
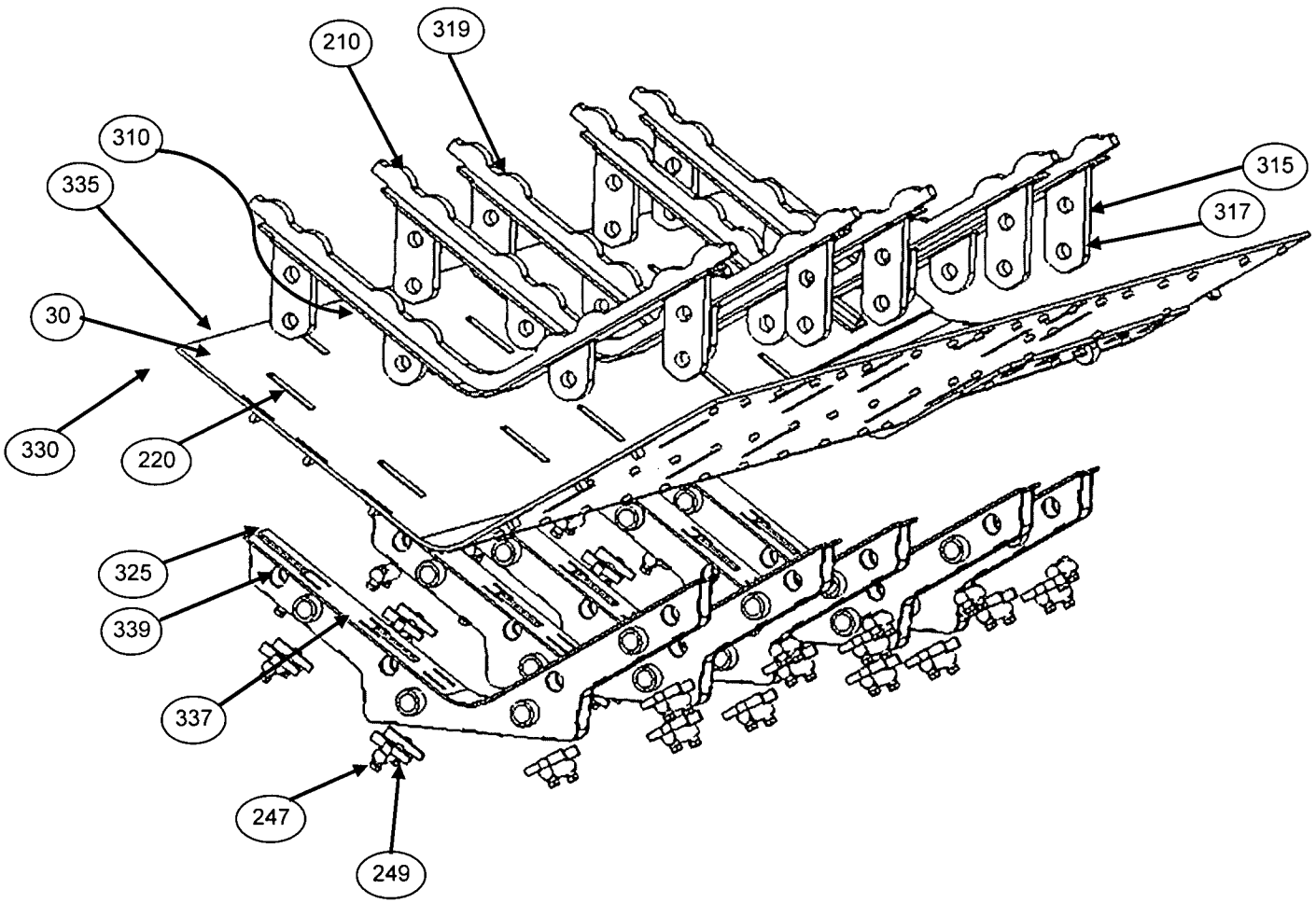

FIG. 3 constitutes an additional "exploded" view presenting the components of an example bottom sector of the combatants' compartment in a wheeled vehicle, jointly with the components of the means in accordance with the present invention, for protection against threats of mines.

Figure 4:
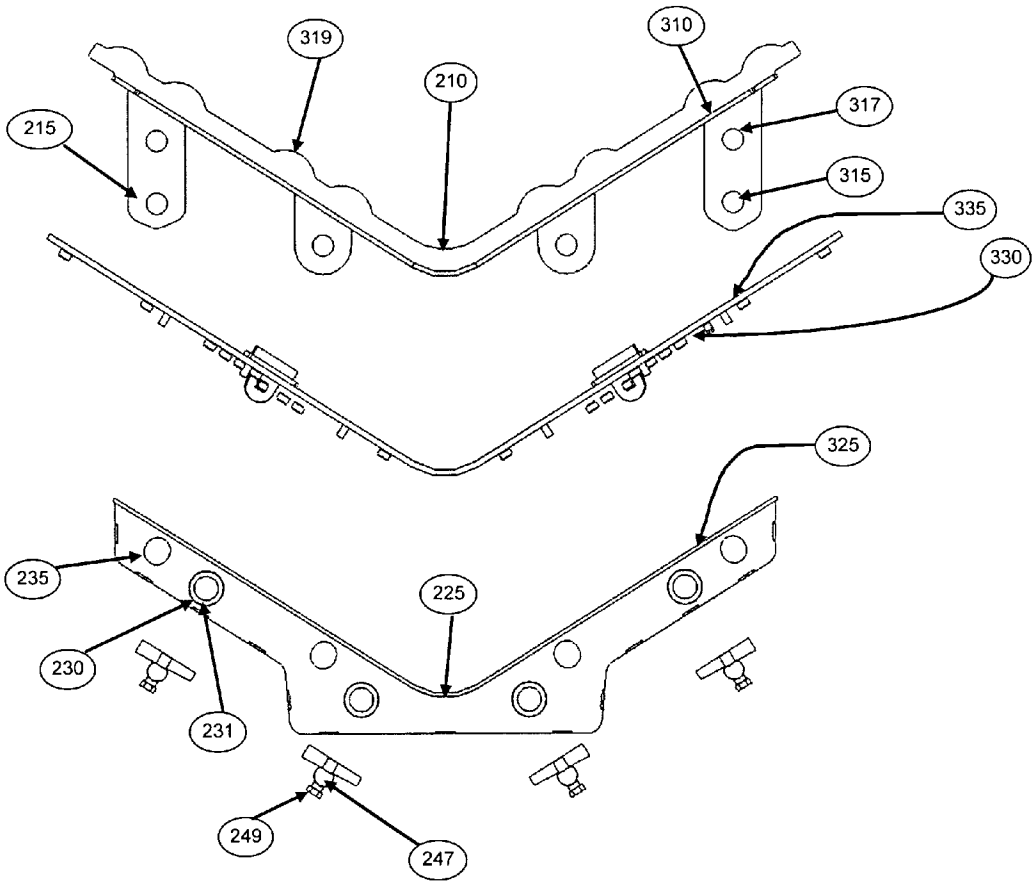

FIG. 4 constitutes a side view presenting the components of an example bottom sector of the combatants' compartment in a wheeled vehicle jointly with the components of the means in accordance with the present invention for protection against threats of mines.

Figure 5:
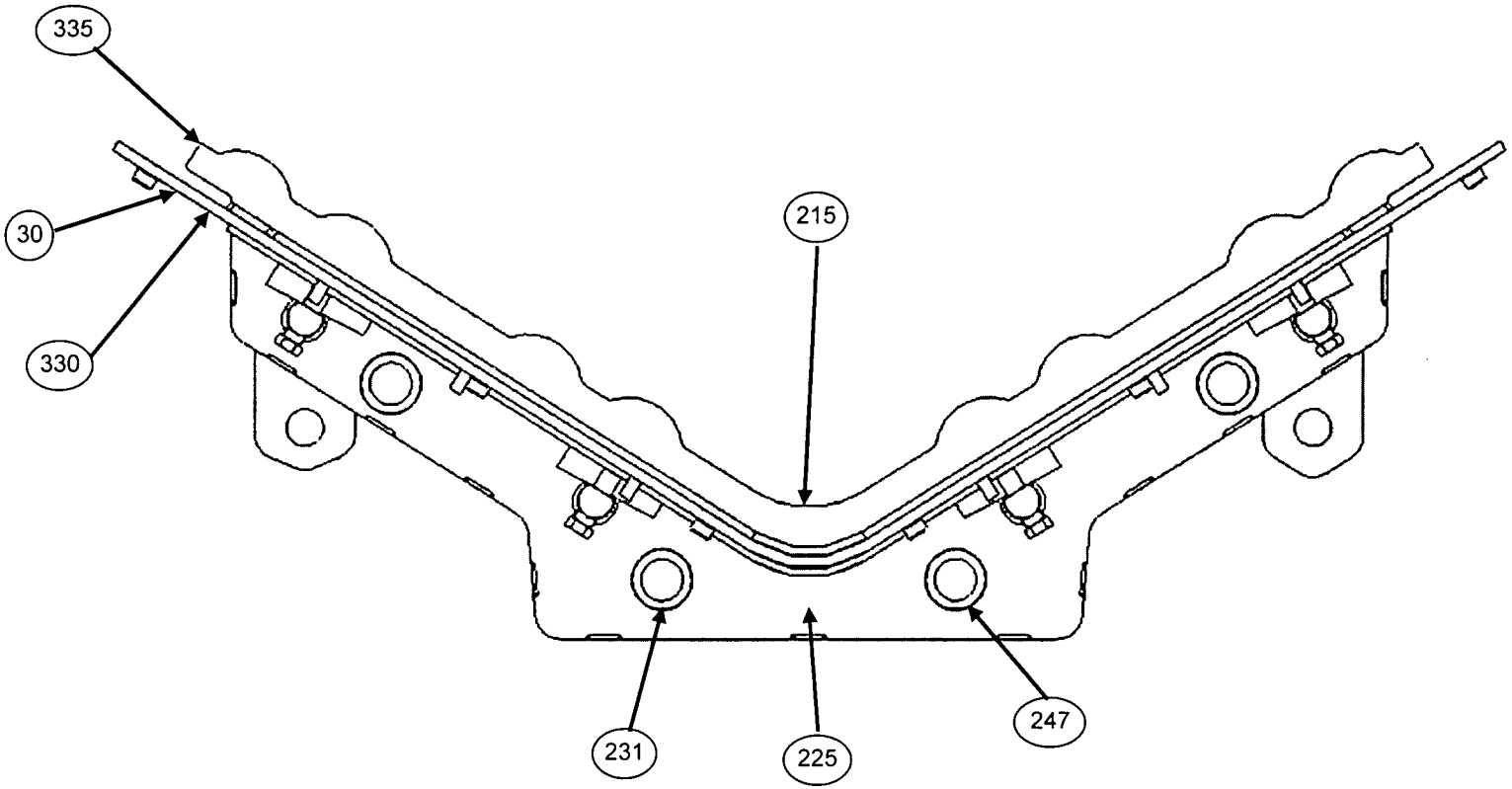

FIG. 5 constitutes a side view showing the components illustrated in FIG. 4, after these components were assembled in accordance with the present invention.

Figure 6:
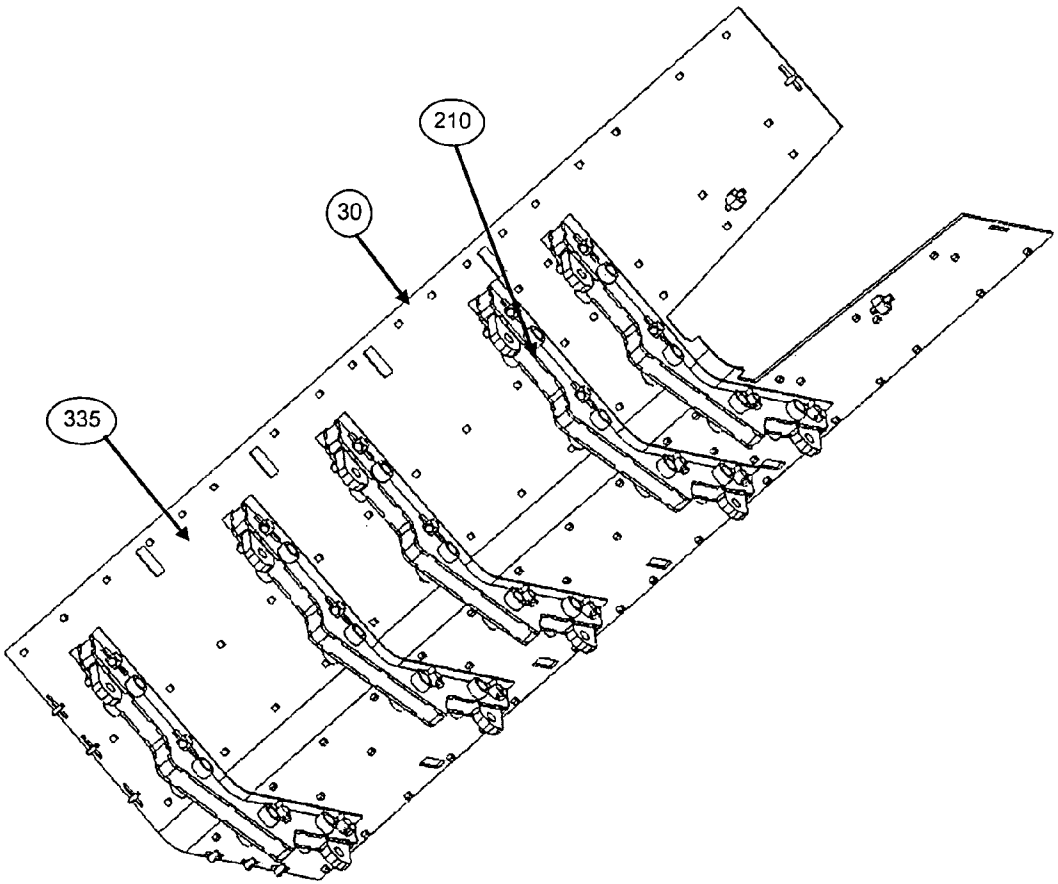

FIG. 6 constitutes an illustration depicting a perspective view (from the interior space) of an example of the bottom sector of the combatants' compartment of the wheeled vehicle in which the components of the means in accordance with the present invention were assembled to protect the vehicle against land mines (the components that were illustrated in the previous figures).

Figure 7:
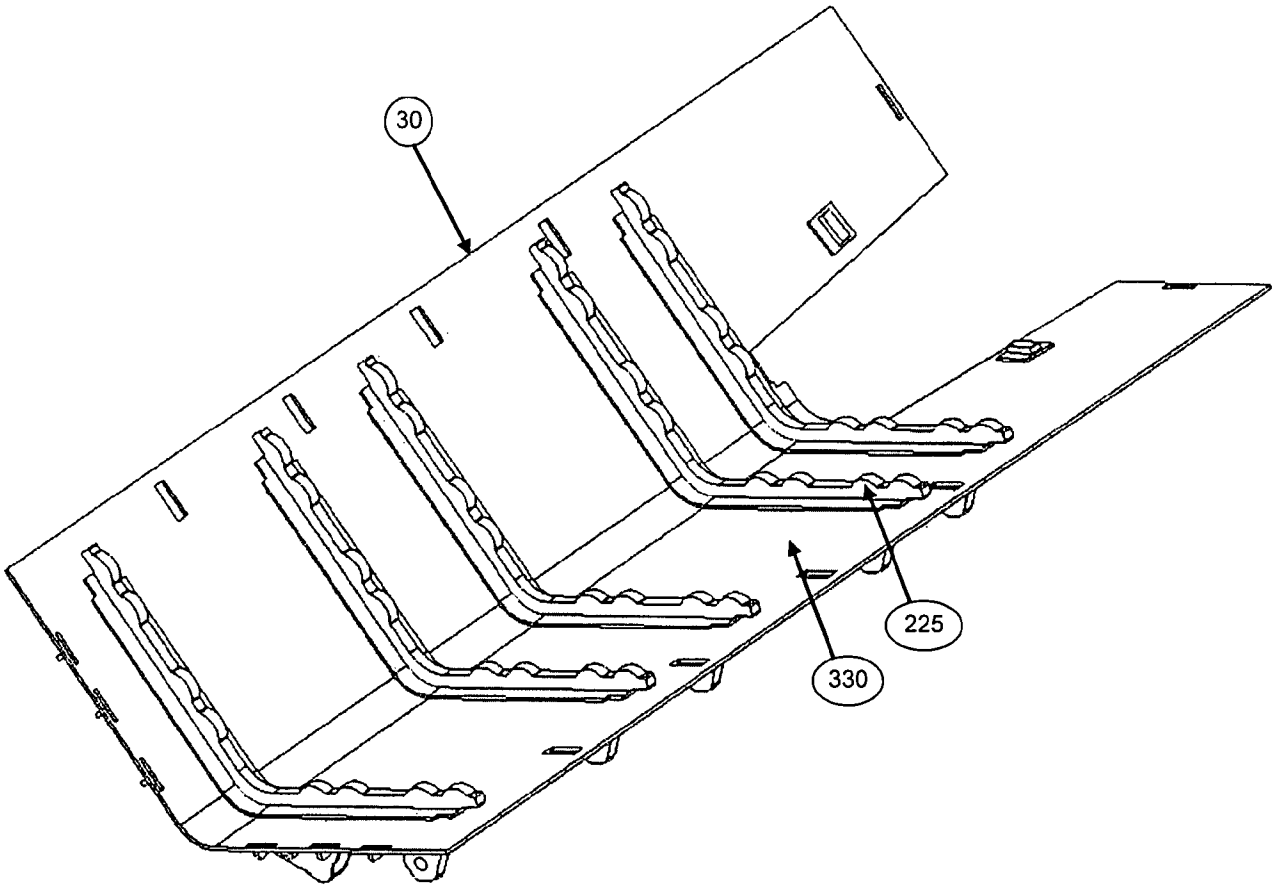

FIG. 7 constitutes an additional perspective view from another angle (in this case from the exterior side) of an example of the bottom sector of the combatants compartment in the wheeled vehicle in which the components of the means in accordance with the present invention were assembled to protect the vehicle against land mines (again—the components that were illustrated in the previous figures).

DETAILED DESCRIPTION OF PREFERRED EMBODIMENT OF THE INVENTION

Let's refer to figures, starting with FIG. 1. FIG. 1 constitutes an illustration view of an example of a wheeled vehicle 10, in which a method and means in accordance with the present invention for protection threats of mines are implemented.

A wheeled vehicle 10 includes chassis 15 and combatants compartment 20.

The combatants' compartment 20 is formed as a kind of a "capsule" which has an inner volume 25 and a bottom (lower) sector 30 that is connectable to chassis 15. The combatants' compartment 20 of the wheeled vehicle 10 may be manufactured form an assortment of varied materials or from a combination of several materials, for example—plates of armor steel, composite materials, ceramics and the like.

As will be explained in detail hereinafter, any professional would appreciate the fact that the present invention, the subject matter of this application, is amenable to be embodied in a large variety of wheeled vehicles, for example—both in vehicles whose combatants' compartment is designed in accordance with the monocoque body concept (carries and withstands the automotive stresses), and—as well—suit a wheeled vehicle whose combatants' compartment is placed on a chassis frame, wherein the frame is the unit that withstands automotive stresses, namely the approach that is known as the Body on a Frame concept.

In the illustrated example, the bottom (lower) sector 30 of the combatants' compartment 20 is formed in a V-shaped like way, in a manner that any professional in this field is familiar with, namely that it contributes to routing (leading) the loads that are actually formed as an outcome from an explosion in a manner that drives them away from the combatants' compartment. But, however, in view of the explanations (that are provided hereinafter), any professional in this field would appreciate the fact that the invention—the subject matter of this patent application, is amenable to be embodied also in a wheeled vehicle whose combatants' compartment is formed in a different configuration that is not V-shaped (for example—to be embodied in a flat undercarriage type of wheeled vehicle).

Wheeled vehicle 10 comprises means 40—in order to connect bottom (lower) sector 30 to chassis 15.

As would be clarified hereinafter, means 40 that is used to connect the bottom (lower) sector 30 to the chassis 15, should be considered as the point of novelty of the invention, the subject matter of the present patent application, and the added advantage and benefit of means 40 is found in that that it serves as an additional protection means of the combatants' compartment 20 of the wheeled vehicle against mining threats.

Reference is being made to FIGS. 2 to 5.

FIG. 2 constitutes an "exploded" view presentation of the components making up an example combatants compartment 20 in a wheeled vehicle 10, that includes the components of means 40 in accordance with the present invention, for protection against threats of mines (mining). In the illustrated example—the components of the walls of the combatants' compartment 20 of the wheeled vehicle are illustrated but they are not designated with part numbers (as they do not constitute a part of this invention). Any professional would also understand that a combatants' compartment as the example compartment 20 might include other components and additional ones (that are not illustrated), as for example "a floating floor", chairs that withstand shocks, combat devices and similar items.

FIG. 3 constitutes an additional "exploded" view presentation of the components of an example bottom sector 30 of the combatants' compartment 20, jointly with the components of means 40 for protecting against mining. FIG. 4 constitutes a side view of bottom sector 30 with means 40 components, while FIG. 5 constitutes a side view showing the components illustrated in FIG. 4, after these components were assembled in accordance with the present invention.

Means 40 that serves for connecting bottom (lower) sector 30 to chassis 15 of vehicle 10 includes a plurality of internal beams 210. In the illustrated example, each one of the internal (inner) beams 210 is formed with anchoring means 215 along its length.

Inner beams 210 are suited to be installed in the inner volume 25 of the combatants' compartment 20, wherein anchoring means 215 pass trough openings 220 that are formed in the bottom (lower) sector 30 of combatants' compartment 20, and protrude from it outwards (see FIGS. 4 and 5), Means 40 for connecting bottom (lower) sector 30 to the chassis 15 of vehicle 10 includes in addition several external beams 225. In the illustrated example, each one of them is formed with means 230 in order to connect to chassis 15 (see FIG. 1), and with means 235 for connecting unto anchoring means 215 of inner beams 210.

In the illustrated example, each one of the inner beams 210 includes a surface portion 310 that is attachable flush unto the inner area surface 335 of bottom sector 30 of the combatants' compartment 20.

Anchoring means 215 of inner beams 210 are formed, in the illustrated example—as tabs 315 that protrude from surface portion 310. Tabs 315 are formed (in the illustrated example) with through-bores 317.

Inner beams 210 include bulges 319 that are formed on the opposite side of tabs 315 and so that they correspond to the respective locations of the tabs 315 along the length of the beam. In the illustrated example, bulges 319 that are formed as arched sectors facing the cohesion line of the edge of tab 315 with the respective beam. Any professional would understand that the purpose (task) of these bulges is the local strengthening of the beams.

In the illustrated example, each one of the external beams 225 includes a surface portion 325 that is attachable flush unto the external area surface 330 of bottom sector 30 of the combatants' compartment 20.

Furthermore, in the illustrated example, means 235 for connecting external beams 225 unto anchoring means 215 are formed as brackets 337. Brackets 337 are suited in their dimensions to accept and integrate tabs 315 in them. Brackets 337 are formed—in the illustrated example, with (passing) through bores 339.

From the instant of integrating tab 315 inside brackets 337 (and see also FIG. 6 and FIG. 7)—passing thru bores 339 are found to be facing the (passing) through bores 317, respectively.

Means 235 for connecting external beams 225 unto anchoring means 215 includes in addition, an array of pins 247 that are suited to be embedded into bores 339 and 317, in a manner that links tabs 315 with brackets 337. Means 235 includes also, in addition, a means 249 for applying traction on pins 247 to stray away (distancing) from the external area surface portion 330 of bottom (lower) sector 30, in a manner that fastens the surfaces area portion of inner beams 210, unto the inner area surface portion 335 of bottom (lower) sector 30.

In the illustrated example, means 249 for applying traction on pins 247 include screws that are suited to be threaded into internally threaded counterparts brackets that are formed in the pins and also an array of spacers (not numbered). Fastening the screws into the pins and against the external surface area 330 of the bottom sector 30 leads—as said, to fastening the inner beams 210 unto the inner surface portion 335 of bottom sector 30.

Means 230 for connecting unto chassis 15 (see FIG. 1) that are formed in external beams 225, include passing through bores 231 that are suited to accept the anchoring means of the chassis (for example—pins that are adapted to be embedded in them).

Reference is being made to FIG. 2. In the illustrated example, combatants' compartment 20 includes in addition several dividers 260. Any professional would understand that hardening the combatants' compartment by adding dividers 260 as said constitutes solely an optional construction.

In the illustrated example, each one of dividers 260 is formed with a connecting means 262 along its length. Similarly to inner beams 210, also dividers 260 are installed in the internal space 25 of the combatants' compartment of the wheeled vehicle, wherein connecting means 262 passes through openings 264 that are formed on the walls of the combatants' compartment. Similarly to inner beams 210, also each one of the dividers 260 includes a surface area portion 266 that is attachable flush unto the inner area surface 335 of the walls of the combatants' compartment 20. The connecting means of dividers 260 are also formed as tabs 268 that protrude from surface area sector 266 and include pass through bores 271. The connecting means of dividers 260 comprise, in addition, an array of pins (that are not illustrated) that are suited to be embedded within bores 271 and also there are means (that are not illustrated—for example screws) for applying traction on the pins to stray away (distance) from the external surface areas of the walls of the combatants' compartment in a manner that tightens the ready to be attachable flush surface area sectors of the dividers unto the inner area surfaces of the combatants' compartment 20.

In view of the description presented hereinabove while referring to the accompanying figures, any professional would understand that by resorting to use means 40 in order to connect a bottom sector of a combatants' compartment to a chassis of a wheeled vehicle, as a means for protecting combatants' compartment 20 in the illustrated example against mining, there is actually embodied a general method for protecting combatants' compartments in a wheeled vehicle (a wheeled vehicle of the type that includes a chassis and a combatants' compartment that is formed with an internal space and a bottom area sector that is attachable to the vehicle's chassis).

The method includes the stages of positioning means 40, that is designed to connect a bottom area sector unto the chassis, on both sides of the bottom area sector, wherein inside the internal space of the combatants' compartment—there are located components of means 40 in a configuration of a plurality of inner beams formed, each one of them, with an anchoring means along their length, and wherein the anchoring means pass through openings that are formed in the bottom area sector of the combatants' compartment, and protrude from it outwards.

On the external side of the bottom sector—the components of means 40 are located, embodied by a configuration of plurality of—beams that are formed, each one of them, with means for connecting with the chassis and also with means to connect with the anchoring means of the inner beams. This connection is accomplished on the external side of the bottom sector of the combatants' compartment, executed by connecting unto the anchoring means of the inner beams.

An additional stage in this method, is a fastening step of the inner beams unto the inner surface area of the bottom sector of the combatants' compartment by subjecting the external beams to move away (distancing) from the outer surface area of the combatants compartment's bottom area sector.

Upon implementation of the method in a wheeled vehicle that includes chassis and a combatants' compartment that is formed with an inner space and a bottom sector connectable to the chassis, the bottom section of combatants compartment is armored with the addition of the external beams array while minimal redaction to the available inner space of the compartment is caused, as required to enable the dynamic movement of the bottom sector upon sustaining and absorbing the pressure loads generated by the mine explosion and while providing substantial saving in the vehicle's weight.

Any professional would also appreciate the fact that the components of means 40 in accordance with the present invention (such as the inner and external beam arrays, respectively, as well as the means for their connectivity one to the other), are amenable to fast and low priced manufacturing process, for example from steel plates that are welded one to the other (an outer beam) and a formed steel plate (an inner beam), machine lathed and formed bushings (the bracket), pins, screws/bolts and etc.). All are manufacturing mans and raw materials that are readily available in any manufacturing facility that usually handles manufacturing and installation of armoring means and automotive assemblies.

Any professional would also appreciate the fact that the approach as in the illustrated example, of inserting the anchoring mean of the inner beams and the dividers, through openings that were formed in advance in the walls of the combatants' compartment, as distinguished from welding on to the walls (in the case of a combatants' compartment made of steel plates), enables to preserve the ballistic capabilities of the steel (plates) from which the walls are manufactured (saving the plates from the exposure to thermal trauma as a consequence of welding).

Thus, any professional would understand that implementing the cited usage of means such as means 40 in the illustrated example, in order to connect the bottom sector of a wheeled vehicle's combatants' compartment unto the chassis of the vehicle, contributes to the protection of the combatants' compartment against mining. The subject being considered here is a means that is low priced and relatively simple for manufacturing, installation and up keep. Implementation of means such as means 40 would not involve the need to assign a relatively large dedicated volume solely for the space needs of the protecting means (while, by this act—reducing the free inner space assigned to the combatants and the equipment or resulting in deviation from the boundaries of the vehicle, and this would disrupt its traversablity and increase its endangered silhouette).

Since means such as means 40 serves—from the vehicles functionality aspect, also in order to connecting the combatants compartment's bottom sector unto the automotive chassis of the vehicle, then its self explanatory that using such means in accordance with the present invention—also as a massive protection means, would lead to reducing the quantity of the added and dedicated armoring means, namely of all those means that their entire goal is to provide additional protection while naturally they increase the vehicle's weight. Means such as means 40 is versatile. Relying on an array (assemblage) of beams, enables convenient and easy interfacing of such means 40 with and on a variety of automotive platforms—either existing ones or planned.

Any professional would understand that the present invention, as it was described above—while referring to the accompanying figures, was described solely in a way of presenting examples, and there might be manufactured, installed and implemented other means for protecting the combatants' compartment of the wheeled vehicle against mines and explosives that will be different from what was described above, even introducing changes and additions, but that would not depart from the constructional characteristics of the invention (the subject matter of this application), characteristics that are claimed herein under.

The invention claimed is:

1. A wheeled vehicle that comprises:

a chassis;

a combatants' compartment comprising an internal space and a bottom area sector disposed above, and coupled to, said chassis, said bottom area sector comprising an inner area surface and an external area surface opposite said inner area surface;

a plurality of inner beams that are formed, each one of them, comprising an area surface portion that is oriented towards and coupled to said inner area surface such that said inner beams are installed in said inner space, each of the plurality of inner beams comprising tabs that protrude from said area surface portion of said inner beams and pass through openings that are formed in said bottom area sector of said combatants' compartment and protrude outwards from said inner space beyond said external area surface of said bottom sector;

a plurality of external beams that are formed, each one of them, comprising a surface area portion that is oriented towards and coupled to said external area surface of said combatants' compartment's bottom sector and is parallel and opposite to a corresponding inner beam such that each of the plurality of external beams is a singular element disposed along an entire length of each corresponding inner beam, and each of said plurality of external beams comprising brackets that are suited in their dimensions to integrate said tabs inside said brackets, and with means for connecting unto said tabs of said inner beams, wherein said external beams are installed on said external side of said combatants' compartment's bottom sector and in connection with said tabs of said inner beams; and wherein:

each area surface portion of said inner beam is attachable flush unto said inner area surface of said bottom sector of said combatants' compartment;

said tabs are formed with pass through bores;

each one of said external beams surface area portions is attachable flush unto said external area surface of said bottom sector of said combatants' compartment;

said brackets include pass through bores that upon said tabs are embedded in said brackets, wherein they are located vis a vis said through bores, and wherein said brackets of said external beams with said tabs additionally comprise:

an array of pins that are suited to be embedded in said through bores in a manner that connects said tabs with said brackets, and means for subjecting said pins into distancing from said external area of said bottom sector of said combatants' compartment in a manner that fastens said surface area portions amenable to be fastened flush of said inner beams unto said inner area surface of said combatants' compartment's bottom sector;

wherein said means for subjecting said pins into distancing from said external area of said bottom sector while applying traction on said pins includes screws that are suited to internally threaded brackets that are formed in said pins;

wherein said inner beams comprise bulges that are formed on an opposite side to said tabs and made so that they correspond to respective locations of said tabs along a length of said beam; and wherein said combatants' compartment further comprises a plurality of dividers that are formed, each one of them, with a connecting means along their length, and wherein said dividers are installed in said internal space of said combatants' compartment.

2. A wheeled vehicle in accordance with claim 1, wherein said combatants' compartment's bottom sector is formed in a V-shaped like configuration.

3. A wheeled vehicle in accordance with claim 1, wherein:

said dividers connecting means pass through openings that are formed on walls of said combatants' compartment.

4. A wheeled vehicle in accordance with claim 3, wherein:

each of said dividers includes a surface area portion that is attachable flush unto said inner area surface of said walls of said combatants' compartment;

said connecting means of said dividers are formed as tabs that protrude and extend beyond said surface area portion, and wherein said connecting means of said dividers further comprises pass through bores;

an array of pins that are suited to be embedded in said bores; and means for applying traction on said pins to distance from said external surface of said walls of said combatants' compartment, in a manner that fastens said dividers surfaces area portions that are amenable to be fastened flush unto said inner surface of said combatants' compartment's walls.

5. A method for protecting against explosive charges in a combatants' compartment of a wheeled vehicle of a type that includes a chassis and combatants' compartment that is formed with an inner space and a bottom area sector that is attachable to said chassis, said method comprising:

positioning means for connecting said bottom area sector to said chassis on two opposing sides of said bottom area sector, wherein a plurality of inner beams that are formed, each one of them, with anchoring means along its length, and wherein said anchoring means pass through openings that are formed in said bottom sector of said combatants' compartment and protrude outwards from it, and wherein on an external side of said bottom sector said means is embodied in a configuration of several external beams that are formed, each one of them, parallel and opposite to corresponding inner beams such that each of the plurality of external beams is a singular element disposed along an entire length of each corresponding inner beam with means for connecting with said chassis and also with means to connect unto said anchoring means of said inner beams, to be accomplished on said external side of said bottom sector of said combatants' compartment, by connecting unto said inner beams anchoring means; and fastening said inner beams unto an inner surface area of said combatants' compartment's bottom sector by subjecting said external beams to distancing from said outer surface area of said combatants' compartment's bottom area sector.

6. The method of claim 5, wherein said inner beams comprise bulges that are formed on an opposite side to said anchoring means and made so that they correspond to respective locations of said anchoring means along a length of said inner beams.

7. A wheeled vehicle that comprises:

a chassis;

a combatants' compartment comprising an internal space and a bottom area sector disposed above, and coupled to, the chassis, the bottom area sector comprising an inner area surface and an external area surface opposite the inner area surface;

an inner beam that comprises an area surface portion that is oriented towards and coupled to the inner area surface such that the inner beam is installed in the inner space, each of the plurality of inner beams comprising tabs that protrude from the area surface portion of the inner beams and pass through openings that are formed in the bottom area sector of the combatants' compartment and protrude outwards from the inner space beyond the external area surface of the bottom sector; and an external beam that comprises a surface area portion that is oriented towards and coupled to the external area surface of the combatants' compartment's bottom sector, wherein the external beam is parallel and opposite to a corresponding inner beam such that each of the plurality of external beams is a singular element disposed along an entire length of each corresponding inner beam, and the external beam comprises brackets that are suited in their dimensions to integrate each of the tabs inside the brackets, wherein the external beam is installed on the external side of the combatants' compartment's bottom sector and in connection with all the tabs of the inner beam.

8. A wheeled vehicle in accordance with claim 7, wherein the inner beam comprises bulges that are formed on an opposite side to the tabs and made so that the bulges correspond to respective locations of the tabs along a length of the inner beam.

9. A wheeled vehicle in accordance with claim 7, wherein the combatants' compartment further comprises a plurality of dividers that are installed in the internal space of the combatants' compartment.

* * * * *